US005541817A

United States Patent [19]

Hung

[11] Patent Number: 5,541,817

[45] Date of Patent: Jul. 30, 1996

[54] KEY WITH A BUILT-IN LIGHT

[76] Inventor: Chien-lung Hung, No. 124, Lane 214, Sec. 2, Chunghwa Rd., Taitung, Taiwan

[21] Appl. No.: 492,707

[22] Filed: Jun. 20, 1995

[51] Int. Cl.[6] ..... F21V 33/00

[52] U.S. Cl. ..... 362/116; 362/253; 362/800

[58] Field of Search ..... 362/100, 116, 362/234, 253, 157, 208, 800

[56] References Cited

U.S. PATENT DOCUMENTS

| | | | |
|---|---|---|---|
| 4,276,582 | 6/1981 | Burnett | 362/116 |
| 4,392,186 | 7/1983 | Cziment | 362/116 |
| 4,831,504 | 5/1989 | Nishizawa et al. | 382/100 |

*Primary Examiner*—Stephen F. Husar
*Attorney, Agent, or Firm*—Ross, Clapp, Korn & Montgomery, L.L.P.

[57] ABSTRACT

A key with a built-in light includes a blade, a mercury battery, a plate integrally formed with the blade having a recess with a conductive sheet in a bottom of the recess for receiving the mercury battery and a tongue extending over the recess but not in contact with the mercury battery when the battery is received, a conductive strip formed under the tongue, and a light, received by the plate and directed in a distal tip of the blade, having two wires respectively connected with the conductive sheet in the recess and the conductive strip under the tongue.

3 Claims, 3 Drawing Sheets

KEY WITH A BUILT-IN LIGHT

BACKGROUND OF THE INVENTION

The present invention relates to a key, and particularly to a key having a light for providing a light source to a user.

Locks are commonly-used devices in a modern society. However, it is not easy to exactly see a keyhole at night. For example, a person cannot easily locate a keyhole of a car or a motorcycle parked on a poorly illuminated street nor a keyhole in a poorly illuminated stairway of a department.

SUMMARY OF THE INVENTION

An object of the present invention is to provide a key with a built-in light for illumination.

Another object of the present invention is to provide a key with a built-in light which is light and convenient to replace a battery.

A further object of the present invention is to provide a key with a built-in light which can be used as a keyholder.

According to the present invention, a key with a built-in light comprises a blade, a mercury battery, a plate integrally formed with the blade having a recess with a conductive sheet in a bottom of the recess for receiving the mercury battery and a tongue extending over the recess but not in contact with the mercury battery when the battery is received, a conductive strip formed under the tongue, and a light having two wires respectively connected with the conductive sheet in the recess and the conductive strip on the tongue.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
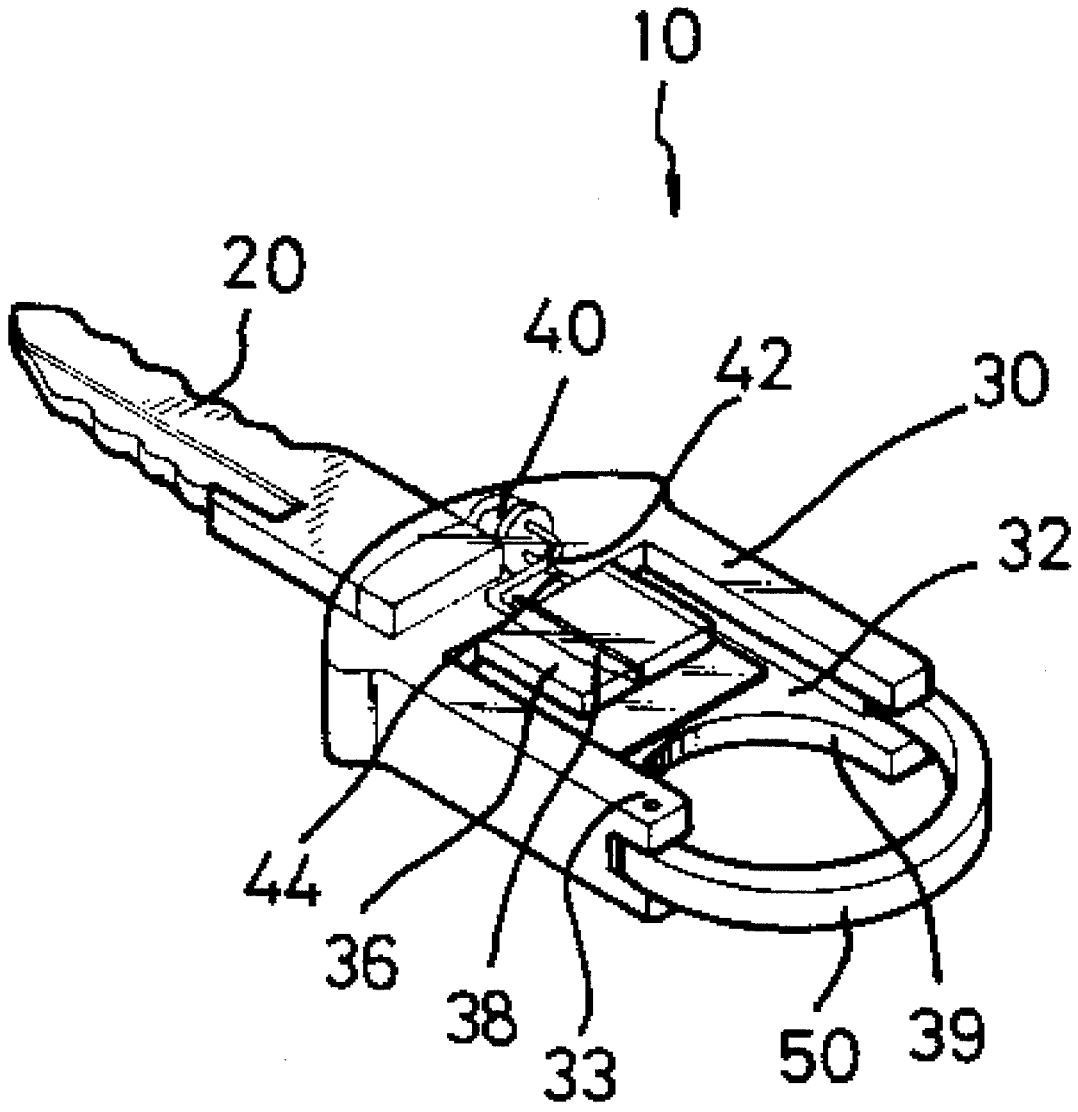
FIG. 1 is a perspective view of a key with a built-in light according to the present invention without equipping with a mercury battery.

Referring to FIG. 1, there is shown a perspective view of a key 10 in accordance with the present invention. As shown, the key 10 includes a blade 20 and a plate 30 integrally formed with the blade 20.

Figure 2:
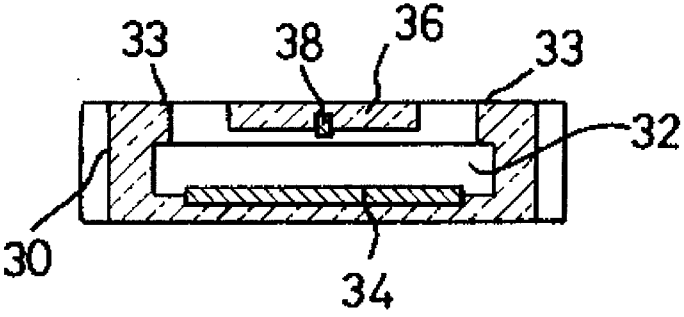
FIG. 2 is a cross-sectional view of a key with a built-in light of FIG. 1.

As shown in FIGS. 1 and 2, the plate 30 includes a recess 32 with an entrance and a flange 33 for receiving a mercury battery (not shown), a conductive sheet 34 coated on a bottom of the recess 32, a tongue 36 made of flexible material extending over the recess 32, and a conductive strip 38 formed on an inner wall of the tongue 36.

A light 40, such as a light emitting diode, is mounted in the plate 30 and directed to a distal tip of the blade 20 with pins 42, 44 respectively connected to the conductive strip 38 under the tongue 36 and the conductive sheet 34 within the recess 32. The bottom of the recess 32 has an arcuate edge 39 at the entrance thereof. An arched bar 50 is hinged in a conventional method to the entrance of the recess 32 to serve as a key holder.

Figure 3:
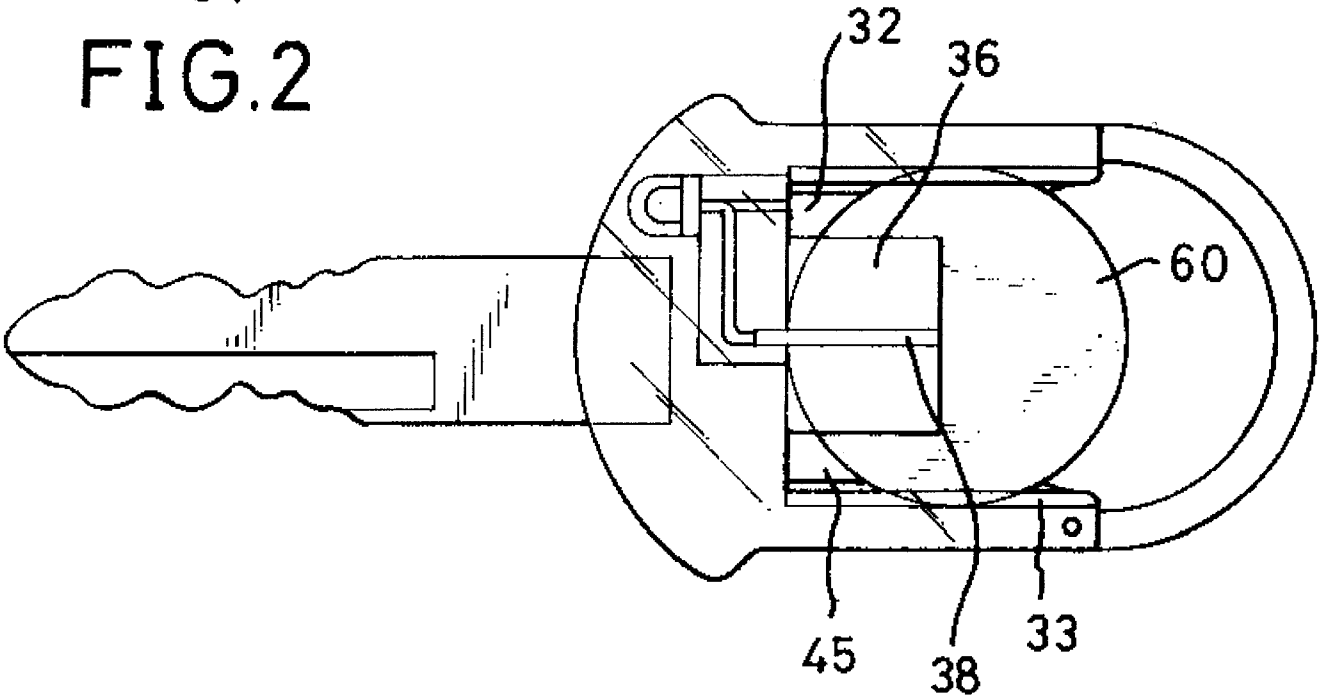
FIG. 3 is a plan view of a key with a built-in light according to the present invention.

As shown in FIG. 3, a mercury battery 60 has been inserted into the recess 32 and secured in place by the flange 33. Thus, the battery 60 is in contact with the conductive sheet 34 (not shown) within the recess 32 but not in contact with the conductive strip 38 under the tongue 36. The mercury battery 60 may be easily replaced by pulling the battery 60 out of the entrance or using a rod (not shown) to insert into a space 45 defined by the battery 60 and the flange 33 and pushing the battery 60 out of the recess 32.

Figure 4:
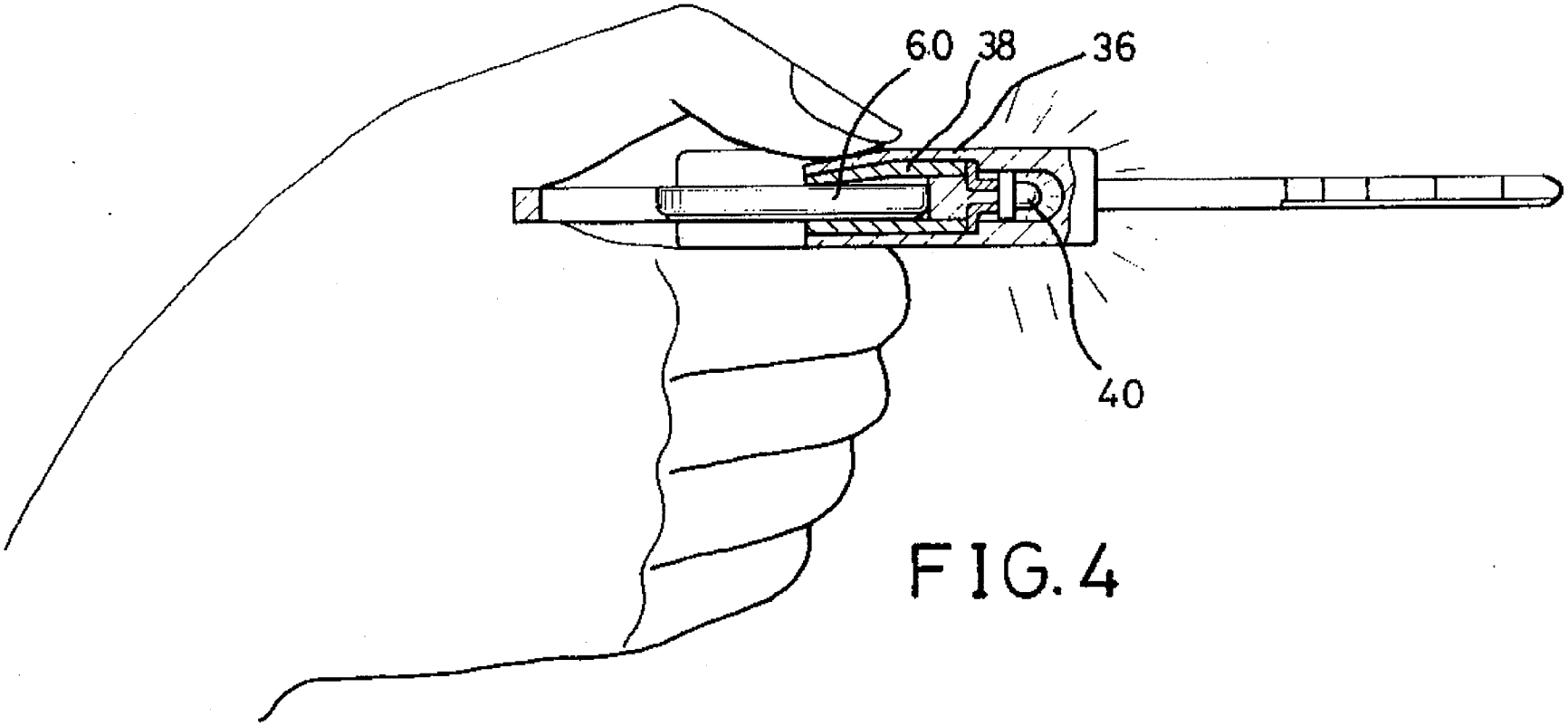
FIG. 4 is a schematic view of a key with a built-in light of FIG. 3 during operation.

Referring to FIG. 4, a user may press the tongue 36 so that the conductive strip 38 is in contact with the battery 60 thereby turning on the light 40.

Although the invention has been explained in relation to its preferred embodiment, it is to be understood that many other possible modifications and variations can be made without departing from the spirit and scope of the invention as hereinafter claimed.

What is claimed is:

1. A key with a built-in light, comprising:

a blade;

a mercury battery;

a plate integrally formed with the blade and having a recess with a conductive sheet in a bottom of the recess for receiving the mercury battery and a tongue extending over the recess but not in contact with the mercury battery when the mercury battery is received;

a conductive strip formed under the tongue; and a light, received by the plate and directed to a distal end of the blade, having two wires respectively connected with the conductive sheet in the recess and the conductive strip under the tongue.

2. The key of claim 1 wherein said recess has an arcuate entrance.

3. The key of claim 1 wherein said light is a light emitting diode.

* * * * *